US006276947B1

(12) United States Patent
Homfeldt et al.

(10) Patent No.: US 6,276,947 B1
(45) **Date of Patent: *Aug. 21, 2001**

(54) U-CRIMP

(75) Inventors: Kent D. Homfeldt, Elgin; Jeff Anderson, South Elgin; Joseph Clark, Crystal Lake, all of IL (US)

(73) Assignee: Illinois Tool Works, Glenview, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/368,239

(22) Filed: Aug. 4, 1999

(51) Int. Cl.[7] ..... H01R 4/66; H01R 11/20
(52) U.S. Cl. ..... 439/92; 439/95; 439/444
(58) Field of Search ..... 439/92, 855, 865, 439/867, 881, 435, 444, 95

(56) References Cited

U.S. PATENT DOCUMENTS

| | | | | |
|---|---|---|---|---|
| 3,340,494 | | 9/1967 | Gutshall . | |
| 3,686,609 | | 8/1972 | Hansen . | |
| 4,126,369 | | 11/1978 | Rapata et al. . | |
| 4,439,971 | * | 4/1984 | Rutherford | 52/584 |
| 4,553,802 | | 11/1985 | Ruehl . | |
| 4,588,240 | | 5/1986 | Ruehl et al. . | |
| 4,993,959 | | 2/1991 | Randolph . | |
| 5,076,626 | * | 12/1991 | Tiddy et al. | 292/337 |
| 5,451,167 | | 9/1995 | Zielenski et al. . | |
| 5,660,297 | * | 8/1997 | Liu | 220/4.02 |
| 6,106,310 | * | 8/2000 | Davis et al. | 439/95 |

* cited by examiner

*Primary Examiner*—Brian Sircus
*Assistant Examiner*—Chaudrika Prasad
(74) *Attorney, Agent, or Firm*—Welsh & Katz, Ltd.; Mark W. Croll, Esq.; John H. Pilarski, Esq.

(57) ABSTRACT

A grounding clip having a generally U-shape spring clamp having first and second opposing walls extending from a curved base portion thereof, the first and second walls each having a leading edge portion opposite the curved base portion. The spring clamp is fastenable to a panel with the curved base portion disposed over the panel edge, the first wall of the spring clamp adjacent one side of the panel and the second wall thereof adjacent the other side of the panel. A wire fastening member, preferably the crimping type, extends from first wall of the spring clamp between the curved base portion of the spring clamp and the leading edge portion thereof. When the spring clamp is fastened to the panel, the wire fastening member and wire fastened thereto are adjacent the corresponding side of the panel and spaced apart from the panel edge, whereby only the curved base portion of the grounding clip protrudes beyond the panel edge.

20 Claims, 2 Drawing Sheets

U-CRIMP

BACKGROUND OF THE INVENTION

The invention relates generally to fasteners, and more particularly to electrical conductor grounding clips and systems.

Grounding clips, referred to also as ground terminals, are known generally and used widely, for example to fasten electrical conductors or wires to conductive appliance panels while providing an electrical contact therebetween. Known grounding clips comprise generally a U-shaped panel contact section, and a wire contact section disposed adjacent to a curved portion or bight of the panel contact section opposite an open end thereof. In other grounding clips, the wire contact section extends axially from the bight of the clip. It is known also to provide one or more barbs protruding from inner sides of the panel contact section to provide improved electrical contact with the panel. See, for example, U.S. Pat. No. 3,686,609 entitled "Ground Terminal", U.S. Pat. No. 4,993,959 entitled "Grounding Clip", and U.S. Pat. No. 5,451,167 also entitled "Grounding Clip".

The prior art grounding clips discussed above however have the disadvantage that portions of the clip and the wire fastened thereto protrude substantially from an edge of the panel upon installation of the clip thereon since the wire is crimped or otherwise fastened adjacent to or protruding from the bight of the clip. This configuration severely limits the range of applications for which the grounding clip may be used, for example it is not possible to place a lid or cover on the panel edge where the clip is fastened because the protruding wire and portions of the clip form a substantial obstruction.

Other known grounding clips fasten the wire between pairs of upstanding blades protruding from the panel contact section thus locating the wire away from the bight. See, for example, the U.S. Pat. No. 5,451,167 entitled "Grounding Clip". With these prior art grounding clips however the wire and upstanding blades protrude substantially from a side of the panel to which the clip is fastened, which protrusion is not always desirable, for example in applications where space is limited or where protruding obstructions are intolerable. Grounding clips having this configuration also require substantial amounts of raw materials, are heavy, are not always manufacturable in strip form, and are relatively costly.

The present invention is drawn toward advancements in the art of grounding clips and systems.

An object of the invention is to provide novel grounding clips and systems that overcome problems in the art.

Another object of the invention is to provide novel grounding clips and systems that are reliable and economical.

Another object of the invention is to provide novel grounding clips that do not protrude substantially from a panel edge when fastened thereto.

A further object of the invention is to provide novel grounding clips and systems wherein portions of the clip and electrical conductor fastened thereto do not protrude substantially from a panel to which the clip is fastened.

Yet another object of the invention is to provide novel grounding clips and systems that require less raw materials and that are relatively lightweight.

Still another object of the invention is to provide novel grounding clips that may be manufactured in strip form.

It is a more particular object of the invention to provide novel grounding clips and systems including ground clips comprising a generally U-shape spring clamp having first and second opposing walls extending from a curved base portion thereof, the first and second walls each having a leading edge portion opposite the curved base portion. The spring clamp is fastenable to a panel with the curved base portion of the clip disposed over the panel edge, the first wall of the spring clamp adjacent one side of the panel, and the second wall thereof adjacent the other side of the panel. A wire fastening member, preferably the crimping type, extends from the first wall of the spring clamp between the curved base portion of the spring clamp and the leading edge portion thereof. When the spring clamp is fastened to the panel, the wire fastening member and wire fastened thereto are adjacent the corresponding side of the panel and spaced apart from the panel edge.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
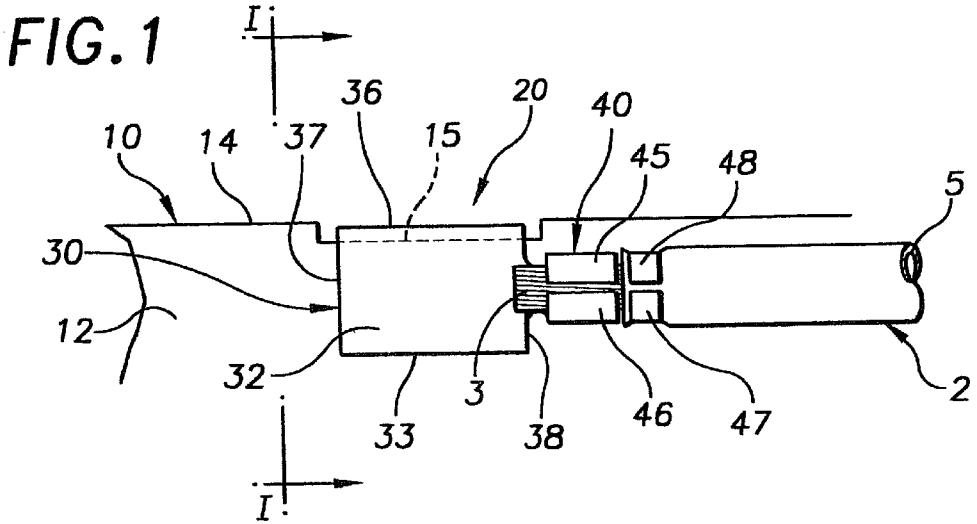
FIG. 1 is a plan view of a grounding clip system according to an exemplary embodiment of the invention.
Figure 2:
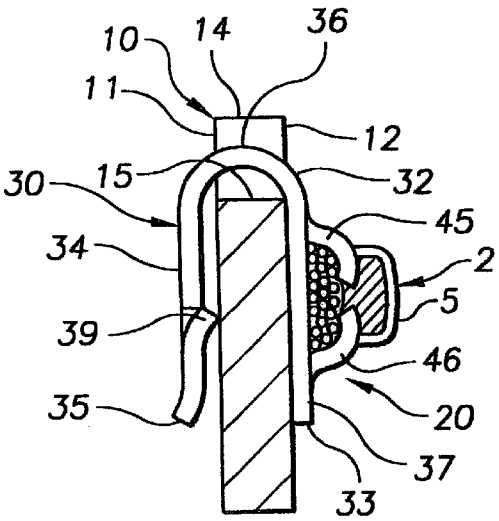
FIG. 2 is a partial sectional view of the grounding clip system of FIG. 1 viewed along lines I—I.

FIGS. 1 and 2 illustrate a grounding clip system comprising generally a conductive panel 10 and a grounding clip 20 fastened thereto while providing preferably an electrical contact between a conductive wire 2 fastened to the clip and the conductive panel.

The conductive panel 10 may be part of an appliance or some other article, for example in an electrical control application, and comprises opposing sides 11 and 12 and a panel edge 14 therebetween. In the exemplary embodiment, the panel 10 has a recessed edge portion 15 having a length along the panel edge 14 greater than or at least as long as a length of the clip 20 to permit recessing all or portions of the clip 20 below the panel edge 14, as discussed further below. More generally, the panel 10 does not have a recessed edge portion, and in those applications or systems only an insubstantial portion of the clip 20 protrudes from the panel edge 14.

In FIG. 1, the grounding clip 20 comprises a generally U-shape spring clamp 30 fastened to the panel 10, and a wire fastening member 40 extending therefrom to which the wire 2 is fastened, as discussed further below. In FIG. 2, the spring clamp 30 comprises generally first and second opposing walls 32 and 34 extending from opposing sides of a curved base portion 36, or bight, thereof. The first and second walls 32 and 34 each have a leading edge portion 33 and 35, respectively, forming an open end of the spring clamp opposite the bight 36 thereof.

Figure 3:
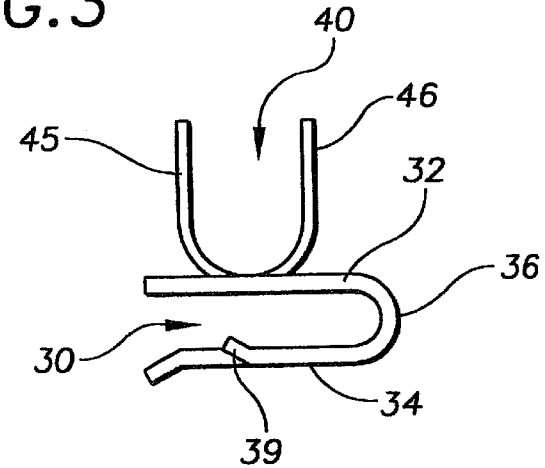
FIG. 3 is an end view of a grounding clip according to an exemplary embodiment of the invention.
Figure 4:
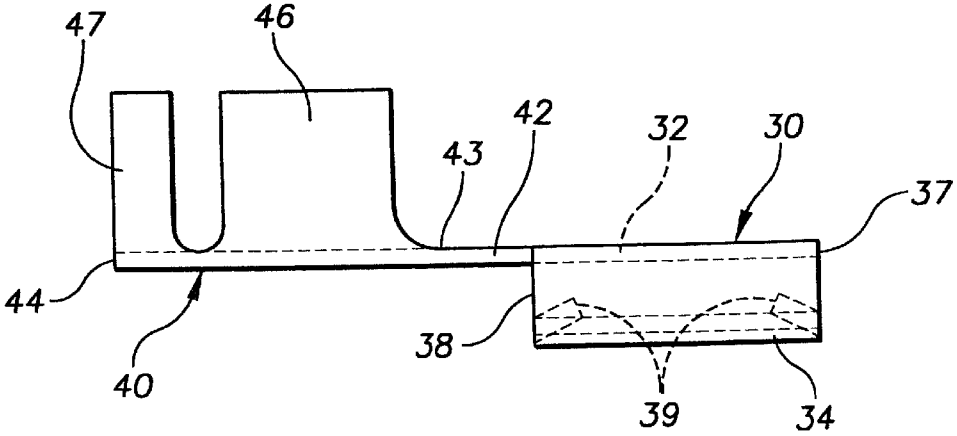
FIG. 4 is a side view of the grounding clip of FIG. 3.

In FIGS. 2 and 3, the first and second walls 32 and 34 each comprise opposing inner and outer sides, the inner side of the first wall facing the inner side of the second wall. In FIGS. 1 and 4, the first and second walls each having opposing ends 37 and 38 between the curved base portion 36 and the leading edge portions 33 and 35 thereof, thus forming opposing ends of the spring clamp 30.

In FIGS. 1 and 2, the spring clamp 30 is fastened to the panel 10 with the curved base portion 36 of the spring clamp disposed over the panel edge 14 or 15, depending on the panel configuration, the first wall 32 adjacent one side of the panel, and the second wall 34 adjacent the other side of the panel.

In some embodiments, one or both of the leading edge portions of the spring clip are configured to diverge outwardly, thereby easing initial installation of the open end of the clip about the panel. Also, in some embodiments, one or both of the first and second side walls of the spring clamp may converge from the bight toward the other to facilitate clamping action when the spring clamp is disposed about the panel, for example the walls may have a skewed chevron shape, so that the spacing between portions of the walls is less that the thickness of the panel. Spring clamp walls having one or more outwardly diverging leading portions are particularly desirable in embodiments where the spacing between portions of the opposing walls is less than the thickness of the panel.

In the exemplary embodiment of FIG. 3, the side walls of the spring clamp 30 are generally parallel to each other, and the leading edge 35 of the second wall 34 diverges outwardly from the other side wall 32 to facilitate installation of the clip on the panel. The second wall 34 also includes a barb protruding from the inner side thereof as discussed below.

In some embodiments, a barb protrudes from the inner side of one of the first and second walls of the spring clip for engagement with the panel, thereby improving electrical contact therewith. In the exemplary embodiment of FIGS. 2 and 3, a barb 39 protrudes inwardly from only the second wall 34, preferably along an end thereof but alternately from any portion thereof. Locating the one or more barbs on only the second wall 34 allows the first wall 32 of the spring clip 30 without any barbs and the wire fastening member 40 thereof to be drawn and mounted directly against a side of the panel 10, thereby minimizing the mounting profile of the grounding clip and wire, particularly the protrusion of the wire fastening member 40 and wire 2 from the side of the panel and maximizing the grounding contact between the panel side and wall 32.

The wire fastening member extends generally from an end of one of the walls of the spring clamp between the curved base portion and the leading edge portion thereof. In the exemplary embodiment of FIG. 1, the wire fastening member 40 extends from the end 38 of the first wall 32 of the spring clamp 30 medially between the curved base portion 36 and the leading edge portion 33 of the spring clamp. The same or a second wire fastening member may extend alternately from the opposing end 37 of the spring clamp.

In FIGS. 1 and 2, the wire 2 is fastened preferably to a wire mounting surface on the outer side of the wire fastening member 40 opposite the panel 30, when the clip is fastened thereto, whereby a portion of the wire fastening member is immediately adjacent the panel to reduce the clip and wire mounting profile. When the grounding clip 20 is installed onto the panel 10, the wire fastening member 40 and the wire 2 fastened thereto are both disposed directly adjacently to the side of the panel 10 and are both spaced apart from the panel edge 14, whereby only the curved base portion 36 of the grounding clip protrudes insubstantially beyond the panel edge 14 or 15.

Figure 5:
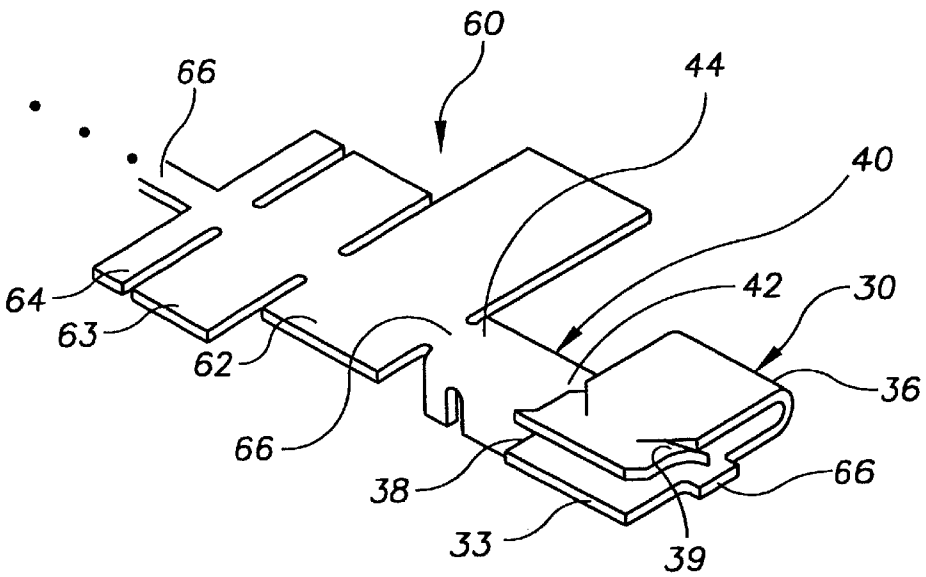
FIG. 5 is a perspective view of a grounding clip manufactured in strip form.

In FIGS. 4 and 5, the wire fastening member 40 comprises preferably a fastening flange 42 with a distal end portion 44 extending from the end 38 of the first wall 32. In FIGS. 1 and 5, the fastening flange 42 is disposed medially between the curved base portion 36 of the spring clamp 30 and the leading edge portion 33 of the first wall. The fastening flange 42 includes opposing inner and outer sides corresponding to the opposing inner and outer sides of the first wall. In FIG. 4, the fastening flange 42 also comprises a mounting surface 43 on the outer side thereof to which the wire is fastenable so that the wire is disposed on the side of the first wall 32 opposite the panel when the grounding clip is fastened thereto.

The location of the wire fastening member 40 spaced away from the bight 36 of the spring clip 30 ensures that the wire 2 fastened thereto will not protrude above the panel edge, as is common with prior art grounding clips. Also, the extension of the wire fastening member 40 from the wall 32 of the spring clip along the side of the panel, and the mounting of the wire 2 on the clip opposite the panel minimizes the extent to which the wire protrudes from the clip and from panel, thereby reducing the overall profile of the clip and wire assembly and reducing space utilization thereby.

The wire 2 is preferably fastened to the wire fastening member 40 by barrel forming arms extending from the wire fastening member thereabout for crimping about the wire. In FIG. 1, arms 45 and 46 extend from the outer side of the fastening flange, also shown in FIG. 3 and partly in FIG. 4. In FIG. 1, the arms 45 and 46 are crimped about a conductive portion 3 of the wire 2. Also in FIG. 1, the exemplary wire fastening flange 40 also comprises secondary arms 47 and 48 nearer the distal end portion thereof, also shown partly in FIG. 4, for crimping about an electrically insulating outer sheath portion 5 of the wire. Alternatively, the wire fastening member 40 may comprise a more completely formed barrel portion which is crimped about a conductive wire portion disposed therein. In other embodiments, the wire may be fastened to the wire fastening member by other known structure or means, including welding and soldering.

As noted above, in the exemplary embodiment, the panel edge 14 has a recessed portion 15 having a length along the panel edge 14 sufficiently wide to accommodate the clip 20 when fastened to the panel 10. The depth of the recessed edge 15 from the panel edge 14 is preferably sufficiently deep, for example as deep as the bight 36 of the spring clamp 30, so that no portion of the clip protrudes above the panel edge 14, whereby a lid or cover, not shown, may be mounted on the panel edge without obstruction. The portion of the clip and particularly the bight thereof protrudes so insubstantially from the panel edge that a lid or cover nevertheless may be mounted on the edge 14 without substantial interference by the clip in the absence of the recessed edge portion 15.

The grounding clip 20 is preferably a unitary metal member comprising for example spring steel, or stainless steel, or some other metal material. The grounding clip may be formed in a stamping operation. FIG. 5 illustrates for example the grounding clip manufactured in strip form, wherein a strip of metal 60 is initially stamped to form a repeating series or sequence of first, second and third members 62, 63, and 64, respectively, which are subsequently formed into the spring clamp, and wire fastening member, respectively. Each sequence of the first, second and third members are spaced apart by a small carrier tab 66, which is easily broken to separate the completely formed grounding clips. Manufacturing the grounding clips of the present invention in strip form eliminates the necessity for costly and wasteful separate carrier members used commonly in the manufacture of prior art grounding clips.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A grounding clip comprising:

a generally U-shape spring clamp having first and second opposing walls extending from a curved base portion thereof, the curved base portion defining a longitudinal axis, the first and second walls each having a leading edge portion opposite the curved base portion, the first and second walls each having opposing inner and outer sides, the first and second walls each having opposing ends between the curved base portion and the leading edge portions thereof;

a wire fastening member extending from an end of the first wall between the curved base portion of the spring clamp and the leading edge portion thereof, the wire fastening member, when bent, defining a longitudinal axis parallel to and spaced from the curved base portion longitudinal axis, a portion of the wire fastening member being coplanar with the first wall.

2. The grounding clip of claim 1, the wire fastening member having a wire mounting surface on a side thereof corresponding to the outer side of the first wall.

3. The grounding clip of claim 1, a barb protruding from the inner side of one of the first and second walls.

4. The grounding clip of claim 1 is a unitary metal member.

5. The grounding clip of claim 1, the wire fastening member is a generally U-shaped member having a fastening flange extending from the end of the first wall, the fastening flange having a wire mounting surface coterminous with the outer side of the first wall, the generally U-shaped wire fastening member having first and second arms extending from the fastening flange transversely to the wall from which the wire fastening member extends.

6. The grounding clip of claim 5, the arms of the wire fastening member form a wire crimping barrel.

7. The grounding clip of claim 5, a barb protruding from the inner side of the second wall of the spring clamp along an end thereof.

8. The grounding clip of claim 5, the spring clamp and wire fastening member constitute a unitarily formed metal member, a barb protruding from the inner side of the second wall.

9. A grounding clip system comprising:

a conductive panel having opposite sides and a panel edge therebetween;

a conductive grounding clip comprising a generally U-shape spring clamp having opposite walls extending from a curved base portion thereof, the walls each having a leading edge portion opposite the curved base portion, the curved base portion defining a longitudinal axis, the spring lamp fastened to the panel with the curved base portion disposed over the panel edge, one wall of the grounding clip adjacent one side of the panel and the other wall of the grounding clip adjacent the other side of the panel, a wire fastening member extending from one of the walls of the spring clamp between the curved base portion thereof and the leading edge portion of the wall from which the wire fastening member extends, the wire fastening member, when bent, defining longitudinal axis parallel to and spaced from the curved base portion longitudinal axis, the wire fastening member having a wire mounting surface coterminous with an outer side of the wall from which the wire fastening member extends, the wire fastening member adjacent the corresponding side of the panel and spaced apart from the panel edge;

a wire fastened to the wire fastening member and spaced apart from the panel edge.

10. The system of claim 9, the panel has a recessed edge portion, the curved base portion of the spring clamp disposed over the recessed edge portion of the panel, no portion of the grounding clip protrudes beyond the panel edge.

11. The system of claim 9, a portion of the wire fastening member coplanar with the wall from which it extends, the wire fastened to the wire fastening member on a side thereof opposite the panel.

12. The system of claim 9, a barb protruding from an inner side of the wall opposite the wall from which the wire fastening member extends, the barb engaged with the panel.

13. The system of claim 9, the grounding clip is a unitary metal member.

14. The system of claim 9, the wire fastening member is a wire crimping barrel having a wire mounting surface extending coterminously with the outer side of the wall from which it extends.

15. The system of claim 14, a barb protruding from an inner side of the wall opposite the wall from which the wire fastening member extends, the barb engaged with a side of the panel.

16. The system of claim 14, the grounding clip is a unitary metal member.

17. The system of claim 14, the grounding clip being a unitary metal member and including a barb protruding from an inner side of the wall opposite the wall from which the wire fastening member extends, the barb engaged with a side of the panel.

18. An integral metal grounding clip comprising:

a generally U-shape spring clamp having first and second opposite walls extending from a curved base portion thereof, the curved base portion defining a longitudinal axis, the first and second walls each having a leading edge portion opposite the curved base portion;

a wire fastening barrel extending from an end of one of the first and second walls of the spring clamp between the curved base portion of the spring clamp and the leading edge portion thereof, the wire fastening barrel, when bent, defining a longitudinal axis parallel to and spaced from the curved base portion longitudinal axis.

19. The grounding clip of claim 18, the wall of the spring clamp having inner and outer surfaces, a wire mounting surface of the wire fastening barrel conterminous with the outer surface of the wall from which it extends.

20. The grounding clip of claim 18, the spring clamp includes a barb an inner side of the wall thereof opposite the wall from which the wire fastening barrel extends.

* * * * *